US006912811B2

(12) United States Patent
Kawashima et al.

(10) Patent No.: US 6,912,811 B2
(45) Date of Patent: Jul. 5, 2005

(54) WINDOW REGULATOR

(75) Inventors: Kimio Kawashima, Tokyo (JP); Nobuji Suzuki, Tokyo (JP); Hideto Yamamura, Tokyo (JP); Takenori Nishimura, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/351,536

(22) Filed: Jan. 27, 2003

(65) Prior Publication Data

US 2003/0140561 A1 Jul. 31, 2003

(30) Foreign Application Priority Data

Jan. 28, 2002 (JP) ..... 2002-018354

(51) Int. Cl.[7] ..... E05F 11/44
(52) U.S. Cl. ..... 49/351; 49/349
(58) Field of Search ..... 49/348, 349, 350, 49/351

(56) References Cited

U.S. PATENT DOCUMENTS 2,777,688 A * 1/1957 Ehrlich et al. ..... 74/89.14
2,817,512 A * 12/1957 Christen ..... 49/26
3,069,152 A * 12/1962 Alfonsas et al. ..... 49/349
3,231,301 A * 1/1966 Gray ..... 403/164
3,398,488 A * 8/1968 Garvey ..... 49/350
3,897,652 A * 8/1975 Hess ..... 49/351
3,965,618 A * 6/1976 Pickles ..... 49/103
4,843,760 A * 7/1989 Hlousek ..... 49/351
4,846,591 A * 7/1989 Dauvergne ..... 384/322
5,079,871 A * 1/1992 Acciacca et al. ..... 49/351
5,595,025 A * 1/1997 MacPhail-Fausey ..... 49/351
6,279,269 B1 * 8/2001 Isomura et al. ..... 49/351

FOREIGN PATENT DOCUMENTS

JP 2000-192727 7/2000

* cited by examiner

*Primary Examiner*—Gregory J. Strimbu
(74) *Attorney, Agent, or Firm*—McGinn & Gibb, PLLC

(57) ABSTRACT

A window regulator includes a main arm, a first sub-arm, and a second sub-arm. The main arm has a hole through it. A flange member surrounds the hole. The first sub-arm includes a shaft section which projects through the hole and is secured to the second-sub arm. In one embodiment, the distal edge portion of the flange member is curved. In a second embodiment, the flange member extends transversely from the main arm, and a low-friction member is between the distal edge portion of the flange member and a surface portion of the first sub-arm. In a further embodiment, the main arm and the second sub-arm have sliding surfaces in contact with each other, and a concave lubricant holding portion is provided on one of the sliding surfaces. The window regulator reduces noise during raising and lowering of the window and ensures rigidity of the first sub-arm.

2 Claims, 7 Drawing Sheets

WINDOW REGULATOR

BACKGROUND OF THE INVENTION

1. Field of the Invention

The present invention relates to a window regulator for raising and lowering a window glass of a vehicle or the like.

The present application claims priority from Japanese Patent Application No. 2002-18354, the disclosure of which is incorporated herein by reference.

2. Description of the Related Art

A conventional window regulator of this kind is known in, for example, JP 2000-192727 A. This window regulator comprises a main arm having a substantially plate-like shape and connected to a window glass side at one end of the main arm and to a driving mechanism side at the opposite end thereof, a first sub-arm arranged on one side of the main arm to be pivotally mounted on the main arm, and a second sub-arm arranged on the other side of the main arm to rotate integrally with the first sub-arm. According to the window regulator, the drive mechanism such as a motor drives the main arm and first and second sub-arms to rotate with respect to each other, thereby raising and lowering the window glass.

The main arm is provided with a through hole, which is surrounded by a flange member formed so as to project from one side of the main arm. The first sub-arm is provided with a shaft section formed thereon so as to project toward the second sub-arm, being in a sliding contact with an inner surface of the flange member corresponding to the hole, and secured to the second sub-arm. This structure allows the first and second sub-arms to rotate around the hole (shaft section).

The first sub-arm is provided with a projection extending toward the main arm and having a circumferential shape surrounding the shaft section. A sliding contact between the projection and the one side of the main arm provides an axially-formed separation between the distal edges of the flange members of the main arm and the first sub-arm, so that the first sub-arm can be prevented from being worn down by the flange member.

The aforementioned window regulator, however, may not ensure the sufficient amount of projection from the first sub-arm, in case of a deterioration of a press die for forming the first sub-arm. This situation makes the flange member of the main arm contact with the first sub-arm, thereby interfering with the function of the window regulator. More specifically, the rotation between the main arm and the first sub-arm in this condition makes an unusual noise between the flange member and the first sub-arm, and further causes wears of the first sub-arm due to frictions with the flange member, thereby reducing significantly a rigidity of the first sub-arm.

Frequent replacement of press dies in a manufacturing line could be considered in order to surely avoid the contact between the flange member and the first sub-arm. This way, however, increases a manufacturing cost of not only the window regulator but also the vehicle.

SUMMARY OF THE INVENTION

It is a primary object of the present invention to provide a window regulator free from an unusual noise accompanying with a relative rotation between a main arm and a first sub-arm, and reliably ensuring a rigidity of the first sub-arm.

To accomplish the above objects, according to one aspect of the present invention, there is provided the window regulator comprising the main arm having a substantially plate-like shape, and connected to a window glass side at one end thereof and to a driving mechanism side at an opposite end thereof, a flange member formed on the main arm so as to surround a hole penetrating the main arm and to project from one side of the main arm, a first sub-arm arranged on the one side of the main arm to rotate around the hole, a second sub-arm arranged on the other side of the main arm to rotate integrally with the first sub-arm, and a shaft section formed on the first sub-arm so as to project toward the second sub-arm, being in a sliding contact with an inner surface of the flange member corresponding to the hole, and secured to the second-sub arm, wherein the flange member has a distal edge portion thereof formed with a convex curved surface toward the first sub-arm.

With this structure, the distal edge portion of the flange member is formed with a curved surface, thereby allowing the edge portion of the flange member to operate in the sliding contact with the first sub-arm without being stuck. Thereby, the frictional resistance between the main arm and the first sub-arm is reduced during the relative rotation between the main arm and the first sub-arm to enable a smoothly sliding contact between the edge portion of the flange member and the first sub-arm. It should be noted that the distal edge portion of the flange member may be configured to be in contact with the first sub-arm, or not to be in contact with the first sub-arm. In the latter case, the distal portion of the flange member and the first sub-arm may contact in case where the first sub arm is not formed into the intended shape due to a deterioration of a press die.

Thus, an unusual noise which often occurs during the respective rotations between the main arm and the first sub-arm can be avoided. Further, a wear of the first sub-arm due to a friction between the first sub-arm and the flange member of the main arm can be also avoided, thereby reliably ensuring the rigidity of the first sub-arm. Moreover, the smooth rotation between the main arm and the first sub-arm can be maintained and so it reduces the driving force required to raise and lower the window glass. This is significantly advantageous for a practical use.

According to another aspect of the present invention, there is provided a window regulator comprising a main arm having a substantially plate-like shape, and connected to a window glass side at one end thereof and to a driving mechanism side at an opposite end thereof, a flange member formed on the main arm so as to surround a hole penetrating the main arm and to project from the one side of the main arm, a first sub-arm arranged on the one side of the main arm to rotate around the hole, a second sub-arm arranged on the other side of the main arm to rotate integrally with the first sub-arm, a shaft section formed on the first sub-arm so as to project toward the second sub-arm, being in a sliding contact with an inner surface of the flange member corresponding to the hole, and a low-friction member interposed between a distal edge portion of the flange member and the first sub-arm.

With this structure, an insertion of the low-friction member between the distal edge portion of the flange member and the first sub-arm can prevent the edge portion of the flange member from directly contacting the first sub-arm. Further, the edge portion of the flange member and the first sub-arm operate in the smooth contact with the low-friction member during the relative rotation between the main arm and the first sub-arm, thereby reducing the frictional resistance between the main arm and the first sub-arm. This structure, thus, allows the main arm and the first sub-arm to rotate smoothly without further application of lubricant such as grease onto the edge portion of the flange member and the first sub-arm. It should be further noted that the low-friction member may be configured to be in contact with the first sub-arm, or not to be in contact with the first sub-arm. In the latter case, the low-friction member and the first sub-arm may contact in case where the first sub arm is not formed into the intended shape due to a deterioration of a press die.

Furthermore, the insertion of the low-friction member between the main arm and the first sub-arm allows a dimensional and/or assembly error between the respective arms in an axial direction, thereby enabling the main arm and the first sub-arm to be fitted together without looseness.

The unusual noise can be thus avoided during the rotation between the main arm and the first sub-arm. Further, the wear of the first sub-arm due to the friction between the first sub-arm and the flange member of the main arm can be avoided, thereby reliably securing the rigidity of the first sub-arm. This configuration differs from a case where a lubricant such as grease is applied between the distal edge portion of the flange member and the first sub-arm, that is, this configuration prevents the unusual noise caused after flowing out of the lubricant by entry of water droplets etc. into the area concerned, thereby preventing an occurrence of a malfunction due to an insufficient watertightness around the window regulator. Moreover, the smooth rotation between the main arm and the first sub-arm reduces the driving force required to raise and lower the window glass. This is also significantly advantageous for a practical use.

Furthermore, a wide allowance range of the dimensional and/or assembly error between the respective arms in the axial direction reduces the cost required to assemble the main arm and the first sub-arm, makes the fixing of the main arm and the first sub-arm much easier, and significantly brings down the manufacturing cost. Moreover, the main arm and the first sub-arm are free from looseness, thereby preventing the unusual noise.

According to a specific embodiment of the present invention, there is provided a window regulator comprising the configuration accompanying the second aspect of the present invention, and another configuration wherein the main arm and the second sub-arm have respective sliding surfaces in a substantially planar contact with each other in a vicinity of a proximal end of the flange member, and the low-friction member is formed so as to cover the distal end portion of the flange member, the inner surface of the flange member corresponding to the hole, and the sliding surface of the main arm.

Besides the advantages according to the second aspect of the present invention, the present embodiment will provide further advantages. That is, the coverage of the low-friction member over the inner surface of the flange member corresponding to the penetrated hole prevents the shaft section of the first sub-arm from directly contacting with the inner surface of the flange member corresponding to the hole. Further, the coverage of the low-friction member on the sliding surface of the main arm against the second arm prevents the sliding surface from directly contacting the sliding surface of the second sub-arm, thereby avoiding the wear between the respective arms.

The outer surface of the shaft section, the inner surface of the flange member corresponding to the hole, and the respective sliding surfaces of the main arm and the second sub-arm are operated in the smoothly sliding contact with the low-friction member, during the relative rotation between the main arm and the respective first and second sub-arms. This structure thus allows the main arm and the first and second sub-arms to rotate smoothly without any further application of the lubricant such as the grease on the outer surface of the shaft section, the inner surface of the flange member corresponding to the hole, and the respective sliding surfaces of the main arm and the second sub-arm.

This configuration largely differs from the case that the lubricant such as the grease would be applied on the outer surface of the shaft section, the inner surface of the flange member corresponding the hole, and the respective sliding surfaces of the main arm and the second sub-arm, that is, this configuration avoids an unusual noise caused by the flowing out of the lubricant due to entry of the water droplets into the area concerned, thereby reliably avoiding an occurrence of a malfunction due to the insufficient watertightness around the window regulator.

Furthermore, the single low-friction member covers the outer surface of the shaft section, the inner surface of the flange member corresponding to the hole, and the sliding surface of the main arm, thereby restricting the number of components. This also provides the advantages in the manufacturing cost.

According to another specific embodiment of the present invention, there is provided a window regulator comprising the configuration accompanying the first or second aspect of the present invention, and another configuration wherein the main arm and the second sub-arm have respective sliding surfaces in a substantially planar contact with each other, and a lubricant holding portion is formed on at least one of the sliding surfaces, the lubricant holding portion being concave away from the opposite sliding surface.

Besides the advantages according to the first or second aspect of the present invention, the present embodiment will provide further advantages, according to which the lubricant holding portion, formed on at least one of the sliding surfaces, holds part of lubricant such as grease applied onto the sliding surfaces. That is, part of the lubricant is saved in the lubricant holding portion, thereby securing the application of lubricant over a long period of time.

Accordingly, lubricant can be fed without deficiency over a long period of time, and the lubricant in the lubricant holding portion will not drain even if the water droplets enter between the respective sliding surfaces. This also serves the smooth rotation between the main arm and the second sub-arm over a long period of time.

BRIEF DESCRIPTION OF THE DRAWINGS

These and other objects and advantages of the present invention will become understood from the following description with reference to the accompanying drawings, wherein.

DESCRIPTION OF THE PREFERRED EMBODIMENTS

Figure 1:
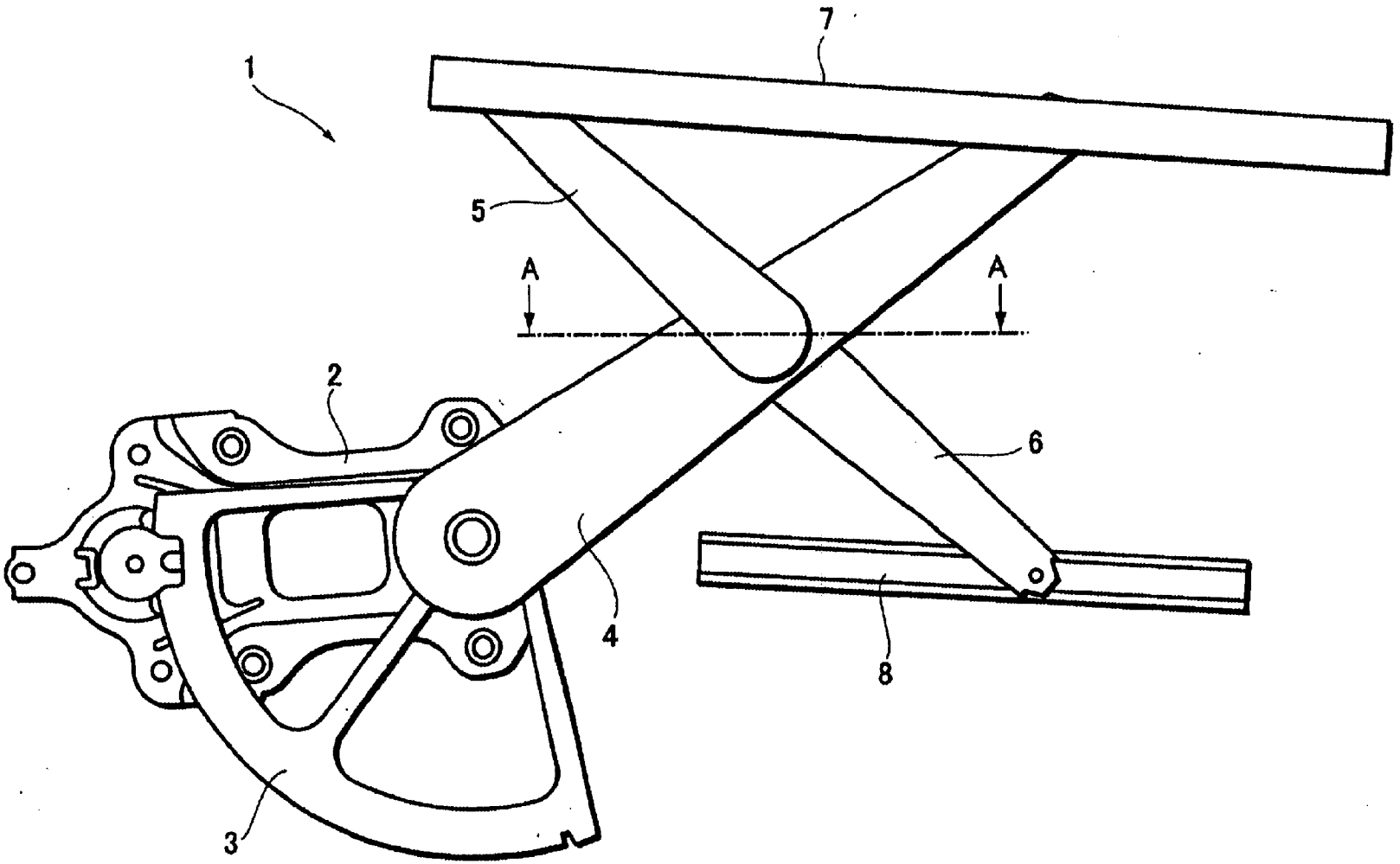
FIG. 1 shows a schematic side view of a window regulator according to the present invention.
Figure 2:
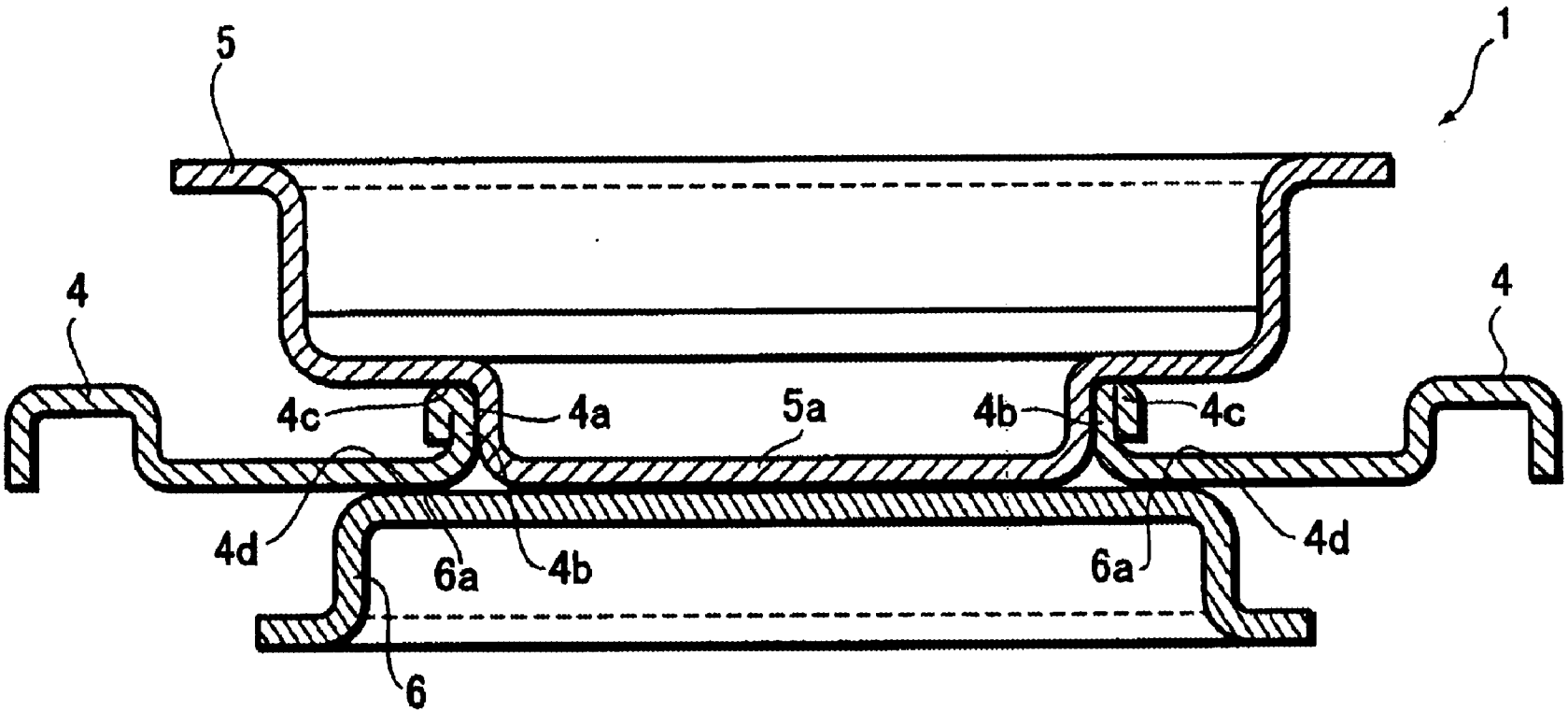
FIG. 2 shows a sectional view taken along a line A—A in FIG. 1 according to the first embodiment of the present invention.

FIG. 1 shows a schematic side view of a window regulator according to the present invention, and FIG. 2 shows a sectional view taken along a line A—A in FIG. 1, which is the first embodiment of the present invention.

The window regulator 1, which is referred to as a so-called X-arm-type, is used for a motor vehicle. As shown in FIG. 1, the window regulator 1 comprises a base plate 2 secured to a door panel of a vehicle, a driven gear 3 rotatably mounted on the base plate 2, and a motor (not shown) for rotatively driving the driven gear 3 via a pinion (not shown). In the present embodiment, the driven gear 3, the motor and the like constitute a drive mechanism. It should be noted that the driven gear 3 is a conventionally known a sector gear and adopted for a reciprocating motion within a certain range of angles.

As shown in FIG. 1, the window regulator 1 further comprises a main arm 4 having a substantially plate-like shape and fixed to the driven gear 3, a first sub-arm 5 arranged on one side of the main arm 4, and a second sub-arm 6 arranged on the other side of the main arm 4 and connected to the first sub-arm 5. Referring now to FIG. 2, a through hole 4*a* is formed at a center of the main arm 4, thereby allowing the first and second sub-arms 5 and 6 to rotate integrally around the hole 4*a*. The first and second sub-arms 5 and 6 are connected to each other in the vicinity of the hole 4*a* so as to align substantially. That is, the first and second sub-arms 5 and 6 intersect the main arm 4 at the hole 4*a* such that the arms 4, 5 and 6 form a x-like shape in a side view, as shown in FIG. 1.

One end of the main arm 4 and that of the first sub-arm 5, as shown in FIG. 1, are slidably connected to a window-side guide 7 which is integrally provided with a window glass (not shown). The window-side guide 7 extends in a substantially horizontal direction. The main arm 4 is connected to one end of the guide 7, and the first sub-arm 5 is connected to the other end of the guide 7. The window-side guide 7 is configured so as to guide the arms 4 and 5 at their connecting parts along a longitudinal direction of the guide 7. That is, the main arm 4 is connected to the window glass side at the one end and to the drive mechanism side at the other end.

The other end of the first sub-arm 5 is connected to one end of the second sub-arm 6. The other end of the second sub-arm 6 is slidably connected to a panel-side guide 8 secured to the door panel. The panel-side guide 8 extends in a substantially horizontal direction, and is configured so as to guide the second sub-arm 6 at the connecting part of the arm 6 along the guide 8.

The above configuration enables the window regulator 1 to operate such that the motor drives the driven gear 3 to be rotated, in turn, allowing the relative rotations between the main arm 4 and the first and second sub-arms 5 and 6, while the parts of the arms 4, 5 and 6 connecting with the guide 7 or 8 slide in a substantially horizontal direction along the respective guide 7 or 8. Since the panel-side guide 8 is fixed to the door panel, the rotation between the arms 4, 5 and 6 moves the window-side guide 7 substantially upward or downward, thereby moving the window glass upward or downward.

In more detail, as shown in FIG. 2, the main arm 4 is integrally formed with a flange member 4*b* surrounding the aforementioned hole 4*a* and extending in the direction of the thickness of the arm 4. The flange member 4*b* projects from one side of the main arm 4, and is formed like a cylindrical shape having an opening toward the first sub-arm 5. A distal edge portion 4*c* (the edge toward the first sub-arm 5) of the flange member 4*b* is subjected to a curling process, more specifically, folding back the edge portion 4*c* of the flange member 4*b* outward from the hole 4*a*. That is, the edge portion 4*c* of the flange member 4*b* is formed with a curved surface convex toward the first sub-arm 5. In the present embodiment, the edge portion 4*c* of the flange member 4*b* is configured so as to be in a sliding contact with a surface of the first sub-arm 5.

In a vicinity of an opposite edge of the first sub-arm 5 is provided a shaft section 5*a* which is formed so as to project toward the second sub-arm 6, in a sliding contact with an inner surface of the flange member 4*b* corresponding to the hole 4*a*, and secured to the second sub-arm 6. The shaft section 5*a* is formed like a cylindrical shape blocking the hole 4*a* on an opening facing toward the second sub-arm 6, and the outer surface of the shaft section 5*a* is in the sliding contact with the inner surface of the flange member 4*b* corresponding to the hole 4*a*. The shaft section 5*a* is attached to the second sub-arm 6 corresponding to the area of the shaft section 5*a* facing toward the sub-arm 6 by welding or the like, thereby allowing the first and second sub-arms 5 and 6 to rotate integrally around the hole 4*a* (shaft section 5*a*). Preferably, lubricant such as grease may be applied between the outer surface of the shaft section 5*a* and the inner surface of the flange member 4*b* corresponding to the hole 4*a* in order to reduce frictional resistance.

The proximal area of the flange member 4*b* of the main arm 4 and the area of the second sub-arm 6 around the shaft section 5*a* of the first sub-arm 5 are configured to be in a sliding contact with each other. That is, the main arm 4 and the second sub-arm 6 have respective sliding surfaces 4*d* and 6*a* substantially in a planar contact with each other. Preferably, lubricant such as grease may be applied between the sliding surfaces 4*d* and 6*a* in order to reduce frictional resistance.

According to the window regulator 1 with the above configuration, the edge portion 4*c* of the flange member 4*b* is formed with the curved surface, thus, the edge portion 4*c* of the flange member 4*b* is in the sliding contact with the first sub-arm 5 without being stuck. This structure reduces the frictional resistance between the main arm 4 and the first sub-arm 5 during the relative rotation of the arms 4 and 5, thereby allowing the edge portion 4*c* of the flange member 4 and the first sub-arm 5 to slide smoothly on each other.

Furthermore, the folded configuration of the edge portion 4*c* of the flange member 4*b* significantly increases the rigidity of the edge portion 4*c* of the flange member 4*b* to rotate the main arm 4 and the first sub-arm 5 stably.

Thus, the window regulator 1 according to the present invention is configured such that the edge portion 4*c* of the flange member 4*b* and the first sub-arm 5 can relatively rotate in smoothly sliding contact with each other. As a result, the main arm 4 and the first sub-arm 5 can be prevented from making an unusual noise during the relative rotation of the arms 4 and 5. Further, wearing of the first sub-arm 5 due to the flange member 4*b* of the main arm 4 can be avoided, thereby reliably ensuring the rigidity of the first sub-arm 4. Moreover, the smooth rotation between the main arm 4 and the first sub-arm 5 can reduce the driving force required to raise and lower the window glass. This is significantly advantageous for a practical use.

In the window regulator 1 according to the present embodiment, the increased rigidity of the edge portion 4*c* of the flange member 4*b* allows the main arm 4 and the first sub-arm 5 to rotate stably. This also effectively restricts vibration caused by the edge portion 4*c* and the first sub-arm 5 operating in the sliding contact with each other, thereby significantly increasing endurance reliability of the window regulator 1.

Although the edge portion 4*c* of the flange member 4*b* of the main arm 4 is formed with the curved surface convex toward the first sub-arm 5 by the curling process according to the first embodiment, the curved surface may be attained by a conventional bending adopted for the portion of the flange member 4*b* toward the first sub-arm 5.

Figure 3:
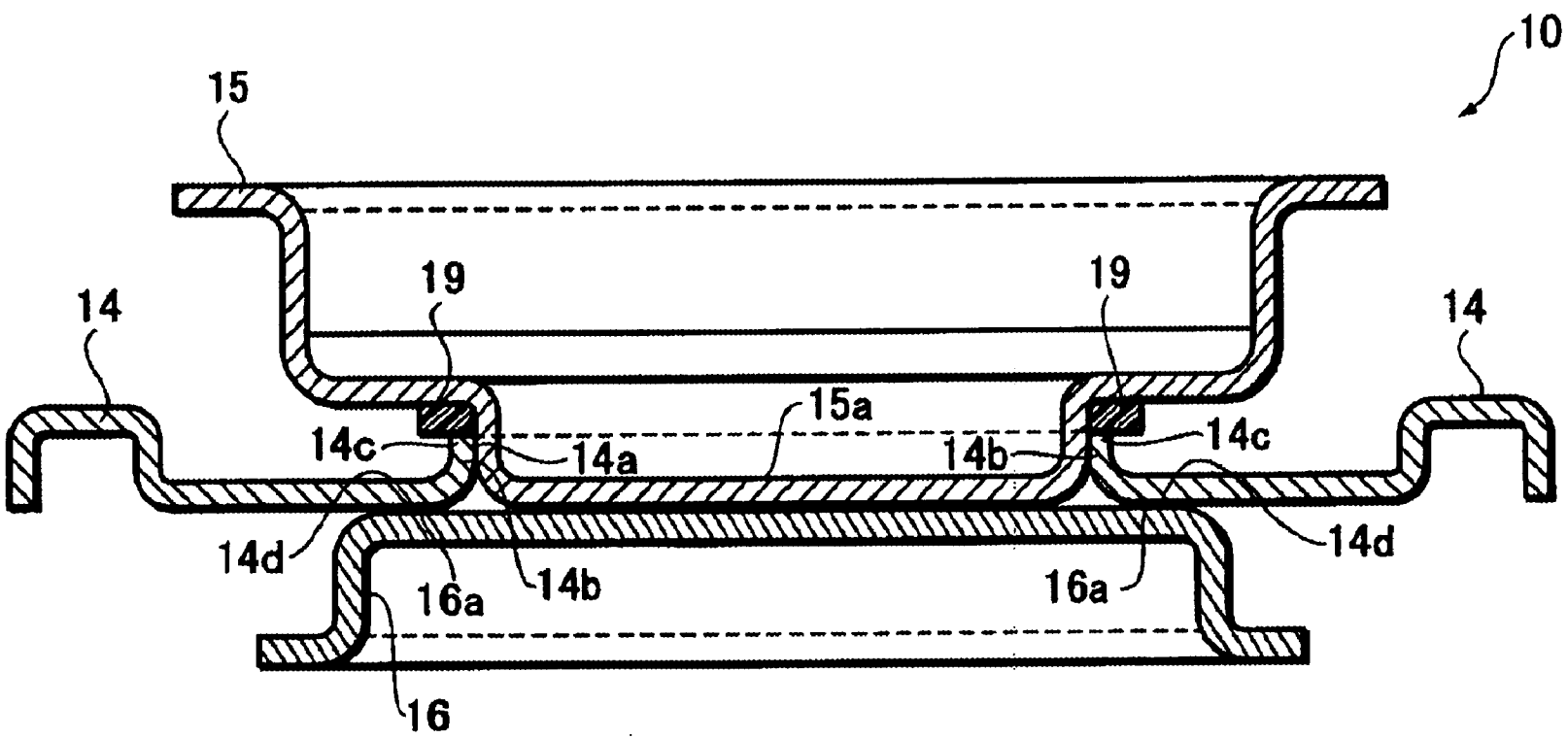
FIG. 3 shows a sectional view taken along a line A—A in FIG. 1 according to the second embodiment of the present invention.

FIG. 3 depicts the second embodiment of the present invention, and also shows a modified example of FIG. 2. The configuration according to the second embodiment differs from that of the first embodiment in the shape of the flange member of the main arm and in that a washer member is provided in a sliding contact with the flange member and the first sub-arm.

A window regulator 10 of the present embodiment also comprises a main arm 14, and first and second sub-arms 15 and 16. The description on a general configuration of the window regulator 10 is omitted, since the configuration is similar to that of the first embodiment illustrated with reference to FIG. 2.

As shown in FIG. 3, a through hole 14*a* is also formed in the main arm 14 of the window regulator 10. The main arm 14 is integrally formed with a flange member 14*b* surrounding the hole 14*a* and extending in the direction of the thickness of the arm 14. The flange member 14*b* is formed like a cylindrical shape having an opening toward the first sub-arm 5. According to the present embodiment, a distal edge portion 14*c* of the flange member 14*b* is formed so as to be off one side of the first sub-arm 15.

In the same fashion as the first embodiment, the first sub-arm 15 is provided with a shaft section 15*a* which is formed so as to project toward the second sub-arm 16, in a sliding contact with the inner surface of the flange member 14*b* corresponding to the hole 14*a*, and fixed with the second sub-arm 16. The shaft section 15*a* is formed like a cylindrical shape blocking the hole 14*a* on an opening facing toward the second sub-arm 16, and the outer surface of the shaft section 15*a* is in the sliding contact with the inner surface of the flange member 14*b* corresponding to the hole 14*a*. The shaft section 15*a* is attached to the second sub-arm 16 corresponding to the area of the shaft section 15*a* facing the arm 16 by welding or the like, thereby allowing the first and second sub-arms 5 and 6 to rotate integrally.

A washer member 19 as a low-friction member impregnated with oil or the like is inserted between the edge portion 14*c* of the flange member 14*b* facing toward the first sub-arm 15 and a surface of the first sub-arm 15, as shown in FIG. 3. The washer member 19 is made from a resin, and formed like a ring. The washer member 19 is arranged so as to be in a sliding contact with the edge portion 14*c* of the flange member 14*b* and the first sub-arm 15.

According to the window regulator 10 with the above configuration, the washer member 19, which is inserted between the edge portion 14*c* of the flange member 14*b* and the first sub-arm 15, prevents a direct contact between the edge portion 14*c* of the flange member 14*b* and the first sub-arm 15. The configuration also allows the edge portion 14*c* of the flange member 14*b* and the first sub-arm 15 to rotate in the sliding contact with the washer member 19 during the relative rotation between the main arm 14 and the first sub-arm 15. That is, the main arm 14 and the first sub-arm 15 can smoothly rotate without special lubricant such as grease to be applied between the edge portion 14*c* of the flange member 14*b* and the first sub-arm 15.

The insertion of the washer member 19 between the main arm 14 and the first sub-arm 15 allows dimensional deviation, assembly deviation and the like in the axial direction between the both arms 14, 15, thereby enabling the arms 14 and 15 to be fitted together without looseness.

Thus, the window regulator 10 according to the present embodiment is configured such that the edge portion 14*c* of the flange member 14*b* and the first sub-arm 15 can relatively rotate in the smoothly sliding contact. This structure prevents the main arm 14 and the first sub-arm 15 from contacting each other not to make an unusual noise during the relative rotation of the arms 14 and 15. Further, wearing of the first sub-arm 15 due to the flange member 14*b* of the main arm 14 is avoided, thereby reliably ensuring the rigidity of the first sub-arm 15. Moreover, the smooth rotation between the main arm 14 and the first sub-arm 15 reduces the driving force required to raise and lower the window glass. This is significantly advantageous for a practical use.

The window regulator 10 according to the present embodiment differs from a case that lubricant such as grease would be applied between the edge portion 14*c* of the flange member 14*b* and first sub-arm 15, that is, the present embodiment prevents an unusual noise caused due to the lubricant flowing out by entry of water droplets etc. into the area concerned, thereby avoiding an occurrence of a malfunction due to insufficient watertightness around the window regulator 10.

The allowance of dimensional deviation, assembly deviation and the like in the axial direction concerning the window regulator 10 according to the present embodiment, reduces the cost required to assemble the arms 14 and 15, makes the fixing of the arms 14 and 15 easier, and significantly brings down the manufacturing cost. Further, the arms 14 and 15 are free from looseness. This point also avoids an occurrence of an unusual noise.

It should be noted that the washer member may be made from a metal impregnated with oil or the like, although the second embodiment has been illustrated with the washer member 19 made from the resin. It should also be noted that the washer member 19 is not restricted to be ring-shaped.

Figure 4:
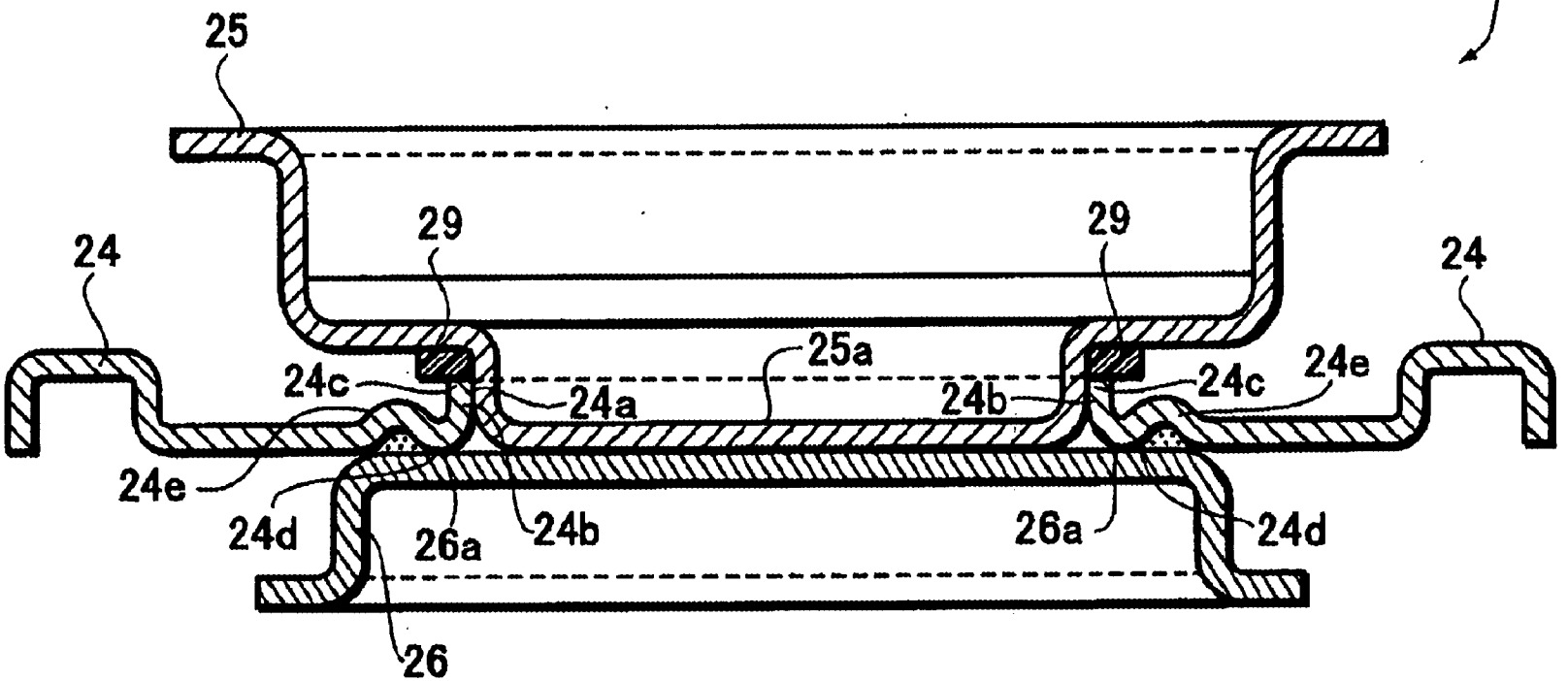
FIG. 4 shows a sectional view taken along a line A—A in FIG. 1 according to the third embodiment of the present invention.
Figure 5:
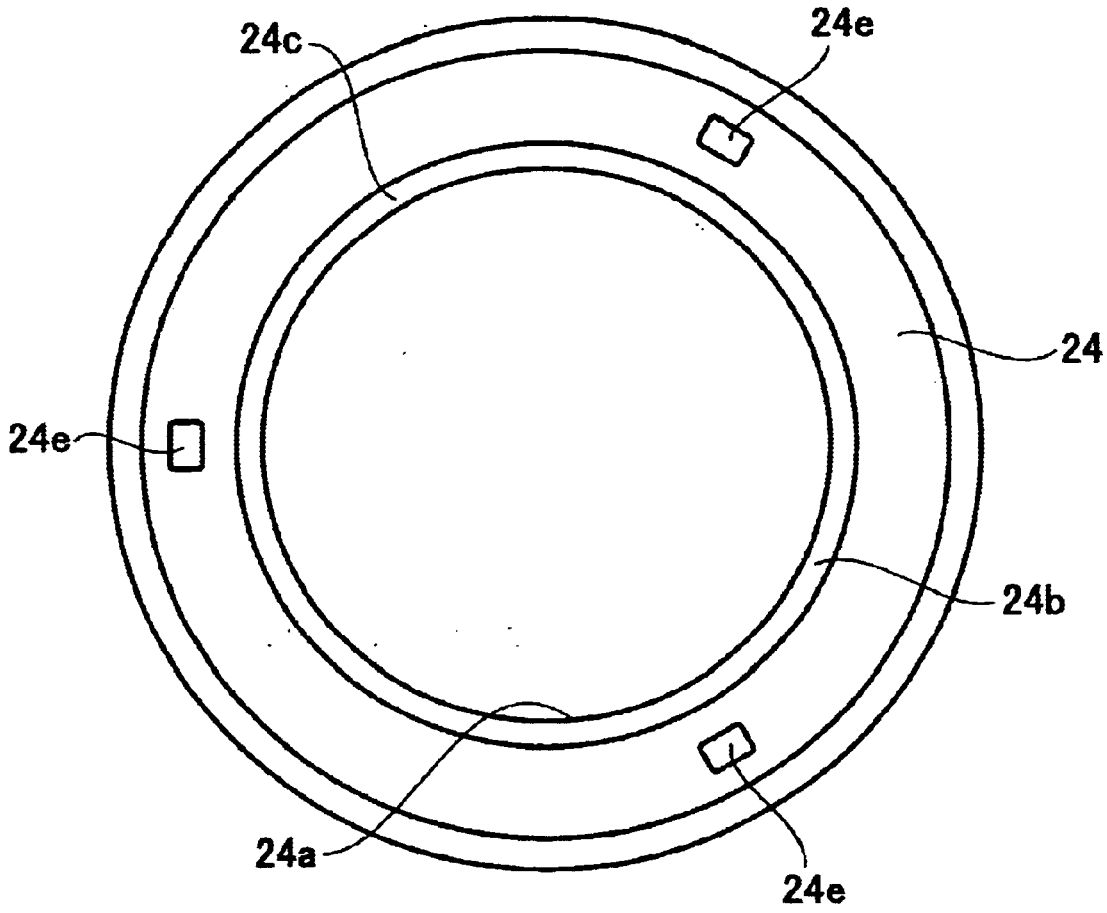
FIG. 5 shows a partial side view of the main arm.

FIGS. 4 and 5 depict the third embodiment of the present invention. FIG. 4 shows a further modified example of FIG. 2, and FIG. 5 shows a partial side view of the main arm. The configuration according to the third embodiment differs from that of the second embodiment in a point that lubricant holding portions are formed on a surface of the main arm in a sliding contact with the second sub-arm according to the third embodiment.

A window regulator 20 comprises a main arm 24, and first and second sub-arms 25 and 26. The description on a general configuration of the window regulator 20 is omitted, since the configuration is similar to that of the first embodiment illustrated with reference to FIG. 2.

As shown in FIG. 4, the main arm 24 is integrally formed with a flange member 24*b* surrounding a through hole 24*a* and extending in the direction of the thickness of the arm 24 in the same fashion as the second embodiment. The first sub-arm 25 is provided with a shaft section 25*a* which is formed so as to project toward the second sub-arm 26, in a sliding contact with an inner surface of the flange member

24*b* corresponding to the hole 24*a*, and fixed to the second sub-arm 26. A washer member 29 or a low-friction member is inserted between a distal edge portion 24*c* of the flange member 24*b* and a surface of the first sub-arm 25.

The proximal area of the flange member 24*b* of the main arm 24 and the area of the second sub-arm 26 around the shaft section 25*a* of the first sub-arm 25 are in a sliding contact with each other. That is, the main arm 24 and the second sub-arm 26 have respective sliding surfaces 24*d* and 26*a* in substantially planar contact with each other.

Lubricant holding beads 24*e* are formed on the sliding surface 24*d* of the main arm 24. Each bead 24*e* is concave away from the sliding surface 26*a* on the second sub-arm 26.

As shown in FIG. 5, in the present embodiment, the lubricant holing beads 24*e* or lubricant holding portions extend circumferentially over a certain distance, and are formed at three locations located evenly in a circumference thereof.

According to the window regulator 20 with the above configuration, the lubricant holding beads 24*e* are formed on the sliding surface 24*d* of the main arm 24, part of lubricant such as grease applied to the sliding surfaces 24*d* and 26*a* is held in each bead 24*e*. Thus, part of lubricant is reserved in each bead 24*e* so that sufficient lubricant is supplied between the sliding surfaces 24*d* and 26*a* stably over a long period of time.

As described above, the window regulator 20 of the present embodiment not only has advantages according to the second embodiment, but also ensures an application of lubricant over a long period of time without deficiency, and prevents the lubricant in each bead 24*e* from draining out due to entry of water droplets between the sliding surfaces 24*d* and 26*a*, thereby ensuring the main arm 24 and the second sub-arm 26 to rotate smoothly over a long period of time.

It should be noted that the lubricant holding beads may be formed on the sliding surface 26*a* of the second sub-arm 26, although the third embodiment has been illustrated with the beads 24*e* formed on the sliding surface 24*d* of the main arm 24. The advantages equivalent to those of the third embodiment are attained, provided the lubricant holding beads are formed at least one of the sliding surfaces 24*d* and 26*a*.

Arbitrary number of beads, of course, can be formed in accordance with the specifications of the window regulator, although the third embodiment has been illustrated with three beads 24*e* formed on the sliding surface 24*d*. It should be also noted that lubricant holding beads extending radially may be adopted instead of the aforementioned beads extending circumferentially. It would be further noted that the shape of the lubricant holding portion may be arbitrary.

Figure 7:
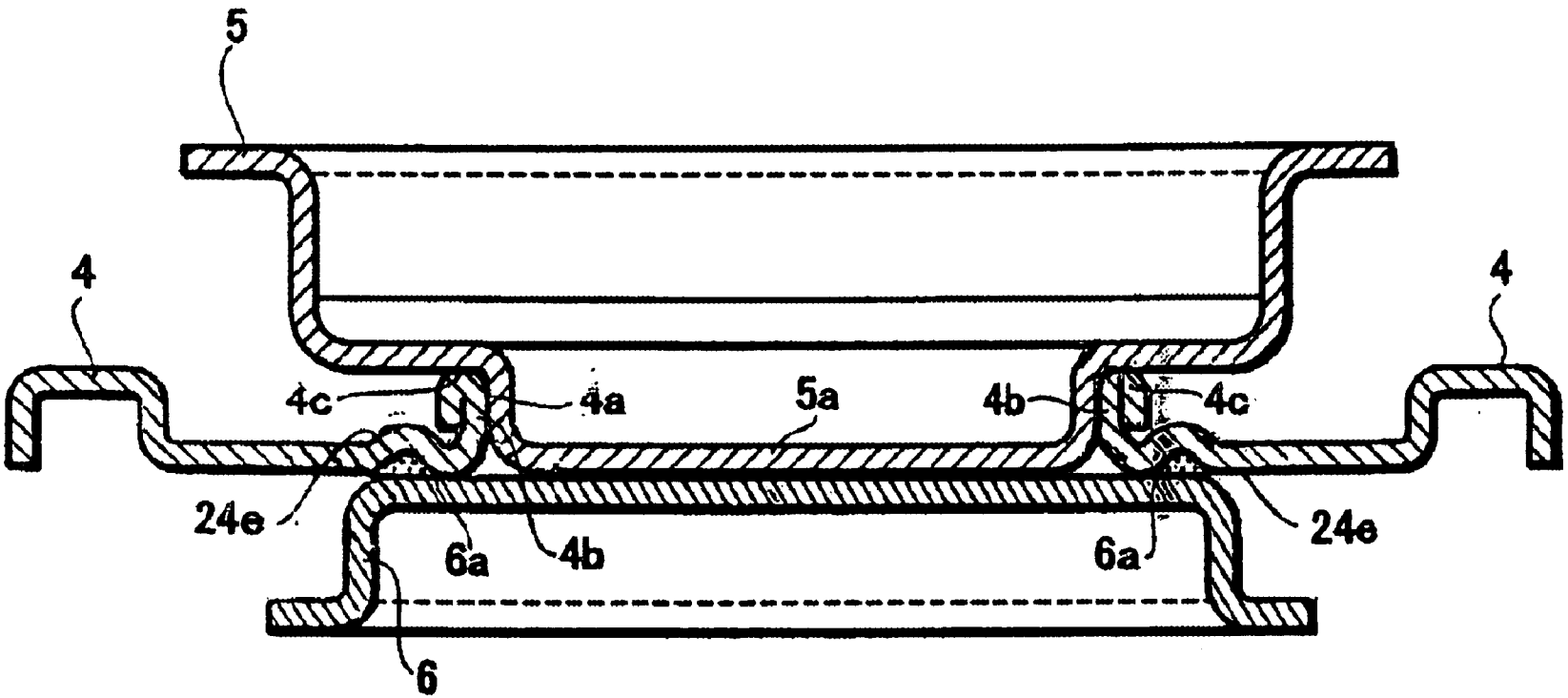
FIG. 7 shows a sectional view taken along line A—A in FIG. 1 according to another embodiment of the invention.

Considering preferable improvement of the first embodiment, the lubricant holding beads maybe formed on at least one of the sliding surface 4*d* of the main arm 4 and the sliding surface 6*a* of the second sub-arm 6 as depicted in FIG. 7. This structure also ensures the main arm 4 and the second sub-arm 6 to rotate smoothly over a long period of time.

Figure 6:
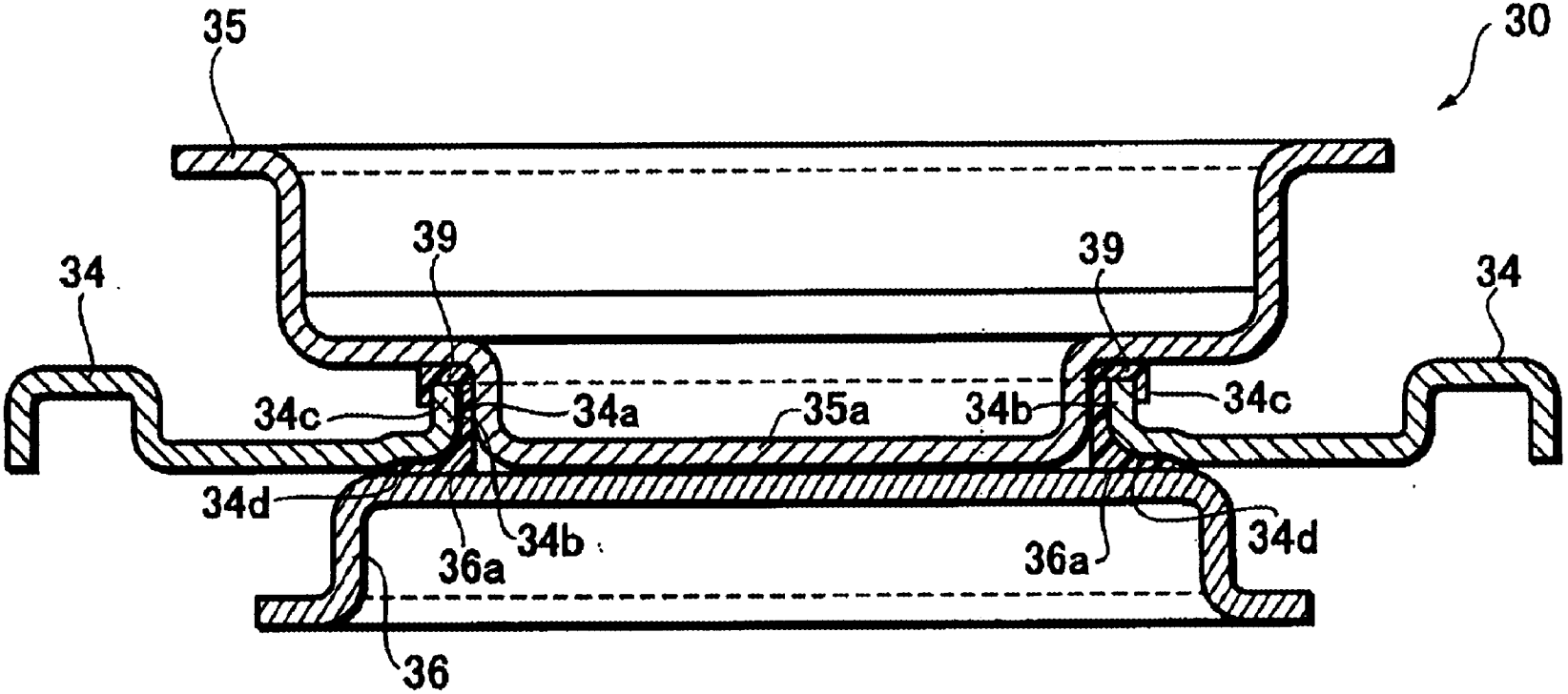
FIG. 6 shows a sectional view taken along a line A—A in FIG. 1 according to the fourth embodiment of the present invention.

FIG. 6 depicts the fourth embodiment of the present invention, and also shows a further modified example corresponding to FIGS. 2, 3, and 4. The fourth embodiment differs from the second embodiment in a point that the washer member of the fourth embodiment is formed like a gutter in a cross section.

A window regulator 30 comprises a main arm 34, and first and second sub-arms 35 and 36. The description on a general configuration of the window regulator 30 is omitted, since the configuration is similar to that of the first embodiment illustrated with reference to FIG. 2.

As with the second embodiment, the main arm 34 is integrally formed with a flange member 34*b* surrounding a through hole 34*a* and extending in the direction of the thickness of the arm 34. The first sub-arm 35 is provided with a shaft section 35*a* which is formed so as to project toward the second sub-arm 36, in a sliding contact with an inner surface of the hole 34*a*, and secured to the second sub-arm 36.

A bushing member 39 or a low-friction member is inserted among the flange member 34*b*, and the first and second sub-arms 35 and 36. The bushing member 39 is formed like the gutter in the cross section so as to cover a distal edge portion 34*c* of the flange member 34*b*, an inner portion of the flange member 34*b* corresponding to the hole 34*a*, and a sliding surface 34*d* of the main arm 34.

According to the window regulator 30 with the above configuration, the bushing member 39 is inserted between the edge portion 34*c* of the flange member 34*b* facing toward the first sub-arm 35 and the first sub-arm 35 to prevent just a distal end of the edge portion 34*c* of the flange member 34*b* from contacting directly with the first sub-arm 35, as with the second embodiment.

The bushing member 39, also covering the inner surface of the flange member 34*b* corresponding to the hole 34*a*, prevents the outer surface of a shaft section 35*a* from contacting directly with the inner surface of the flange member 34*b* corresponding to the hole 34*a*. The bushing member 39, further covering the sliding surface 34*d* of the main arm 34 and a sliding surface 36*a* of the second sub-arm 36, prevents the sliding surfaces 34*d* and 36*a* from contacting directly with each other.

Thus, the edge portion 34*c* of the flange member 34*b* and the first sub-arm 35, of course, operate in a smoothly sliding contact with the bushing member 39 during the main arm 34 and the first and second sub arms 35 and 36 rotate with respect to each other. The outer surface of the shaft section 35*a* and the inner surface of the flange member 34*b* corresponding to the hole 34*a* also operate in a smoothly sliding contact with the bushing member 39 during the rotation. Likewise, the sliding surfaces 34*d* and 36*a* operate in a smoothly sliding contact with the bushing member 39 during the rotation. Accordingly, each frictional resistance among the arms 34, 35 and 36 decreases during the respective rotations thereof.

This structure alleviates the necessity of lubricant such as grease to be applied to the edge 34*c* of the flange member 34*b*, the first sub-arm 35, the outer surface of the shaft section 35*a* and the inner surface of the flange member 34*b* corresponding to the hole 34*a*, and the sliding surfaces 34*d* and 36*a*. The present embodiment, thus, allows the main arm 34 and the first and second sub-arms 35 and 36 to rotate smoothly without each application of lubricant to any portion concerning the sliding contact of the arms 34, 35 and 36.

The insertion of the bushing member 39 between the portions concerning the sliding contact of the main arm 34 and the first and second sub-arms 35 and 36 allows dimensional deviation, assembly deviation in the axial or radial direction, thereby enabling the arms 34, 35 and 36 to be fitted together without looseness.

As described above, the allowance of the dimensional deviation, assembly deviation in the axial or radial direction according to the window regulator 30 in the present embodiment reduces the cost required to assemble the arms 34, 35 and 36, makes the fixing of the arms 34, 35 and 36 very easier, and significantly reduces the manufacturing cost. Further, the arms 34, 35 and 36 are free from looseness. This structure also prevents an occurrence of an unusual noise.

Differing from the present invention, a window regulator with lubricant such as grease applied among the outer surface of the shaft section 35*a*, the inner surface of the flange member 34*b* corresponding to the hole 34*a*, the sliding surface 34*d* of the main arm 34, and the sliding surface 36*a* of the second sub-arm 36, may have possibility of making an unusual noise. That is, in this case, the unusual noise may occur because of water droplets entered there into to drain the lubricant out. On the other hand, the window regulator 30 according to the present embodiment can avoid the problem of unusual noise. The window regulator 30 further can prevent an occurrence of a malfunction due to insufficient watertightness around the window regulator 30. Further, the present embodiment requires no special lubricant, because every portion concerning the sliding contact of the arms 34, 35 and 36 operates in the sliding contact with the bushing member 39. This point also is significantly advantageous for a practical use.

In addition, the window regulator 30 according to the present embodiment enables a single bushing member 39 to cover the edge portion 34*c* of the flange member 34*b*, the inner portion of the flange member 34*b* corresponding to the hole 34*a*, and the sliding surface 34*d* of the main arm 34. This structure restricts the number of components, thereby providing advantages in the manufacturing cost.

Although the fourth embodiment is shown with the bushing member 39 interposed between the sliding surfaces 34*d* and 36*a*, the bushing member may have a shape not being interposed between all the sliding surfaces, but a lubricant holding portion may be formed on at least one of any sliding surfaces.

In the first to forth embodiments, the edge portion of the flange member or the low-friction member is in contact with the first sub-arm. Instead of this configuration, it may be configured such that the edge portion of the flange member or the low-friction member is off the first sub-arm. In the latter case, the advantages equivalent to that of the above embodiments can be attained when the edge portion of the flange member and the first sub-arm contact with each other. In other words, this contact may occur in the case that the first sub arm or the like is not formed into the predetermined shape due to deterioration of a press die.

It should be noted that it is arbitrary how the first and second sub-arms are fixed to each other. Other specific details in structure and the like may, of course, be changed arbitrarily.

As described above in detail, the present invention allows the edge portion of the flange member and the first sub-arm to operate in the smoothly sliding contact. Such a structure prevents an occurrence of an unusual noise during the rotation between the main arm and the first sub-arm, and also prevents the first sub-arm from being worn by the flange member of the main arm, thereby reliably ensuring the rigidity of the first sub-arm.

While the presently preferred embodiments of the present invention have been shown and described, it is to be understood that these disclosures are for the purpose of illustration and that various changes and modifications may be made without departing from the scope of the invention as set forth in the appended claim.

What is claimed is:

1. A window regulator, comprising:

a main arm having a first end adapted to be connected to a window glass and a second end adapted to be connected to a driving mechanism, said main arm having a hole therethrough with a flange member surrounding the hole and projecting from a first side of said main arm;

a first sub-arm on said first side of said main arm and having a shaft section projecting into the hole and slidingly contacting an inner surface of said flange member; and a second sub-arm on a second side of said main arm and connected to said shaft section to rotate integrally around the hole with said first sub-arm, wherein said flange member has a distal edge portion formed with a convex curved surface extending toward said first sub-arm, said main arm and said second sub-arm include respective sliding surfaces in substantially planar contact with each other, and at least one of said sliding surfaces includes thereon a concave lubricant holding portion extending away from the other one of said sliding surfaces and holding a lubricant.

2. The window regulator according to claim 1, wherein said distal end portion is folded back to form the convex curved surface.

* * * * *